US009739548B1

(12) United States Patent
Alhajri

(10) Patent No.: US 9,739,548 B1
(45) Date of Patent: Aug. 22, 2017

(54) HYDRO-BLASTING ANTI-WITHDRAWAL DEVICE SUPPORT

(71) Applicant: EQUATE PETROCHEMICAL COMPANY, Safat (KW)

(72) Inventor: Suhaim M. H. R. Alhajri, Safat (KW)

(73) Assignee: EQUATE PETROCHEMICAL COMPANY, Safat (KW)

( * ) Notice: Subject to any disclaimer, the term of this patent is extended or adjusted under 35 U.S.C. 154(b) by 0 days.

(21) Appl. No.: 15/433,004

(22) Filed: Feb. 15, 2017

(51) Int. Cl.

| | |
|---|---|
| ***B23Q 1/00*** | (2006.01) |
| ***F28G 15/02*** | (2006.01) |
| ***F28G 1/16*** | (2006.01) |
| ***F28D 7/10*** | (2006.01) |
| ***F28F 9/12*** | (2006.01) |

(52) U.S. Cl.
CPC ..... *F28G 15/02* (2013.01); *F28D 7/103* (2013.01); *F28F 9/12* (2013.01); *F28G 1/163* (2013.01)

(58) Field of Classification Search
None
See application file for complete search history.

(56) References Cited

U.S. PATENT DOCUMENTS

| | | | | |
|---|---|---|---|---|
| 4,004,698 | A | 1/1977 | Gebelin | |
| 5,092,572 | A * | 3/1992 | Litwak | A61F 2/28 269/253 |
| 5,676,197 | A | 10/1997 | Diebold et al. | |
| 7,789,966 | B2 | 9/2010 | Kramer et al. | |
| 8,393,063 | B2 * | 3/2013 | Hodges | B25B 5/068 269/128 |
| 2009/0146354 | A1 * | 6/2009 | Metroyanis | E04G 21/1891 269/43 |
| 2012/0175078 | A1 | 7/2012 | Saxon et al. | |
| 2014/0252711 | A1 * | 9/2014 | Tropea | B25B 1/06 269/90 |
| 2015/0034128 | A1 | 2/2015 | Brumfield | |

FOREIGN PATENT DOCUMENTS

| | | |
|---|---|---|
| JP | 62-223598 | 10/1987 |
| JP | 3-267697 | 11/1991 |

OTHER PUBLICATIONS

"Articulate Flex Lance Safety Stop" http://www.advancedpressuresystems.com/APS-chicken-wing.htm (Accessed on Oct. 24, 2016) 3pgs.

* cited by examiner

*Primary Examiner* — Lee D Wilson
(74) *Attorney, Agent, or Firm* — Richard C. Litman

(57) ABSTRACT

The hydro-blasting anti-withdrawal device support is used for mounting an anti-withdrawal device (AWD) utilized when cleaning heat exchanger tubes in a shell-and-tube heat exchanger where the tube sheet is recessed within the shell. The support includes a shell flange attachment plate, an AWD attachment plate, and a pipe spacing the two plates apart. Each plate is substantially rectangular and has a pipe attachment tab extending therefrom, the pipe attachment tabs extending in opposite directions. In use, the shell flange attachment plate is secured to the shell flange, the anti-withdrawal device is secured to the AWD attachment plate, and the pipe is dimensioned to support the AWD in close proximity to the heat exchanger tube sheet.

1 Claim, 3 Drawing Sheets

HYDRO-BLASTING ANTI-WITHDRAWAL DEVICE SUPPORT

BACKGROUND OF THE INVENTION

1. Field of the Invention

The present invention relates to heat exchangers, and particularly to a hydro-blasting anti-withdrawal device support for mounting a hydro-blasting anti-withdrawal device in the proper position for cleaning heat exchanger tubes, particularly for shell-and-tube heat exchangers where the tube sheet is recessed from the end of the shell.

2. Description of the Related Art

Shell-and-tubes heat exchangers are commonly used in oil refineries and petrochemical plants. The shells are elongated, cylindrical outer casings. Bundles of tubes are supported within the shells and extend from one end of the shell to the other. The tubes are secured to holes in the tube sheets at opposite ends of the shell (for linear tubes; U-tubes may be secured to a single tube sheet at one end of the shell) by welding or by rolled mechanical joints. A first heat exchanger fluid circulates through the tubes and a second heat exchange fluid circulates through the shell outside the tubes for heat exchange. The ends of the shell are typically covered or capped by channel heads that direct the flow of fluid in the tubes, the heads being bolted or secured to a shell flange.

From time to time, flow through the tubes may be restricted or impaired by corrosion or by the settling of solids in the tubes, which reduces the efficiency of the heat exchanger and may require a plant shut-down for cleaning the tubes. Cleaning heat exchanger tubes positioned within a heat exchanger is a practice in the petrochemical industry that requires absolute precision. Accordingly, such a process is often undertaken with the use of a hydro-blasting machine and an anti-withdrawal device. Hydro- or water-blasting is a cleaning method that utilizes a highly-pressurized stream of water to remove old paint, chemicals, or the build-up of coke, solidified carbon, or even metal, without damaging the underlying structure. The pressurized stream of water is delivered through a hose and a lance (which may be rigid or flexible) inserted into the tube. Since the pressurized flow may result in back-pressure that forces the lance back out of the tube, the lance is usually secured by an anti-withdrawal device for the health and safety of workers cleaning the tubes. Flushing each heat exchanger tube with such a highly-pressurized and sometimes extremely hot, stream of fluid can prevent or reduce the accumulation of contaminants within each heat exchanger tube, which might otherwise limit the flow of fluids through each heat exchanger tube, and thereby allows for efficient operation of the heat exchanger.

In some heat exchangers, the tube sheet is positioned adjacent to the end of the shell or outer casing of the heat exchanger. This allows the anti-withdrawal device to be clamped to the shell flange while an adjustable arm clamps or locks the hose within an inch or two of the tube sheet with the lance extending into the tube.

In other heat exchangers, however, the tube sheet is recessed within the shell, such that the anti-withdrawal device cannot be mounted to place the adjustable clamping arm in close proximity of the tube sheet. The greater the distance between the hose and the tube sheet, the greater the chance that the lance may withdraw from the tube and seriously injure the person cleaning the heating tubes of the heat exchanger.

Thus, a hydro-blasting anti-withdrawal device support solving the aforementioned problems is desired.

SUMMARY OF THE INVENTION

The hydro-blasting anti-withdrawal device support is used for mounting an anti-withdrawal device (AWD) utilized when cleaning heat exchanger tubes in a shell-and-tube heat exchanger where the tube sheet is recessed within the shell. The support includes a shell flange attachment plate, an AWD attachment plate, and a pipe spacing the two plates apart. Each plate is substantially rectangular and has a pipe attachment tab extending therefrom, the pipe attachment tabs extending in opposite directions. In use, the shell flange attachment plate is secured to the shell flange, the anti-withdrawal device is secured to the AWD attachment plate, and the pipe is dimensioned to support the AWD in close proximity to the heat exchanger tube sheet.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The hydro-blasting anti-withdrawal device support is used for mounting an anti-withdrawal device (AWD) utilized when cleaning heat exchanger tubes in a shell-and-tube heat exchanger where the tube sheet is recessed within the shell. The support includes a shell flange attachment plate, an AWD attachment plate, and a pipe spacing the two plates apart. Each plate is substantially rectangular and has a pipe attachment tab extending therefrom, the pipe attachment tabs extending in opposite directions. In use, the shell flange attachment plate is secured to the shell flange, the anti-withdrawal device is secured to the AWD attachment plate, and the pipe is dimensioned to support the AWD in close proximity to the heat exchanger tube sheet.

Figure 3:
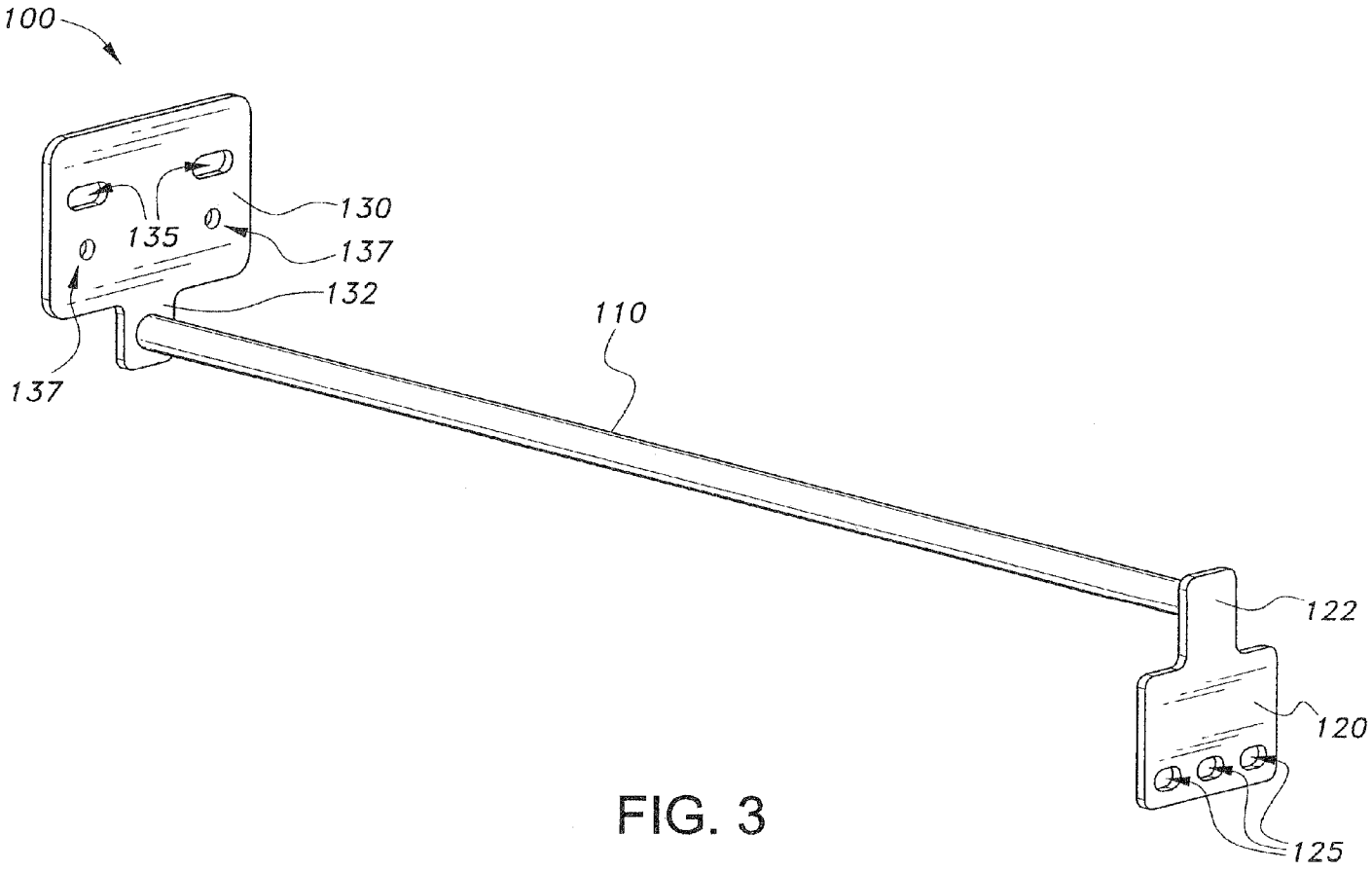
FIG. 3 is a perspective view of a hydro-blasting anti-withdrawal device support according to the present invention.

As shown in FIG. 3, the hydro-blasting anti-withdrawal device support 100 has a shell flange attachment plate 120, an AWD attachment plate 130, and a pipe 110 or other shaft spacing the two plates 120, 130 apart. The pipe 110 may have a fixed length, or in some embodiments, the pipe 110 may have an adjustable length. Each plate 120, 130 is substantially rectangular and has a corresponding pipe attachment tab 122, 132 extending therefrom, the pipe attachment tabs 122, 132 extending in opposite directions, substantially 180°. The pipe 110 is rigidly attached to the plates, e.g., by welding. The pipe 110 extends normal to the plane of the plates 120, 130. The shell flange attachment plate 120 has a plurality of slots 125 defined therein. In FIG. 3, the shell flange attachment plate 120 is shown having three slots 125 aligned linearly, but the plate may have a greater or lesser number of slots 125, and the slots 125 may be disposed in a different pattern, or randomly. Similarly, the anti-withdrawal device (or AWD) attachment plate 130 has a plurality of slots 135 defined therein, and may also have a plurality of bolt holes or through-bores 137 defined therein.

Figure 1:
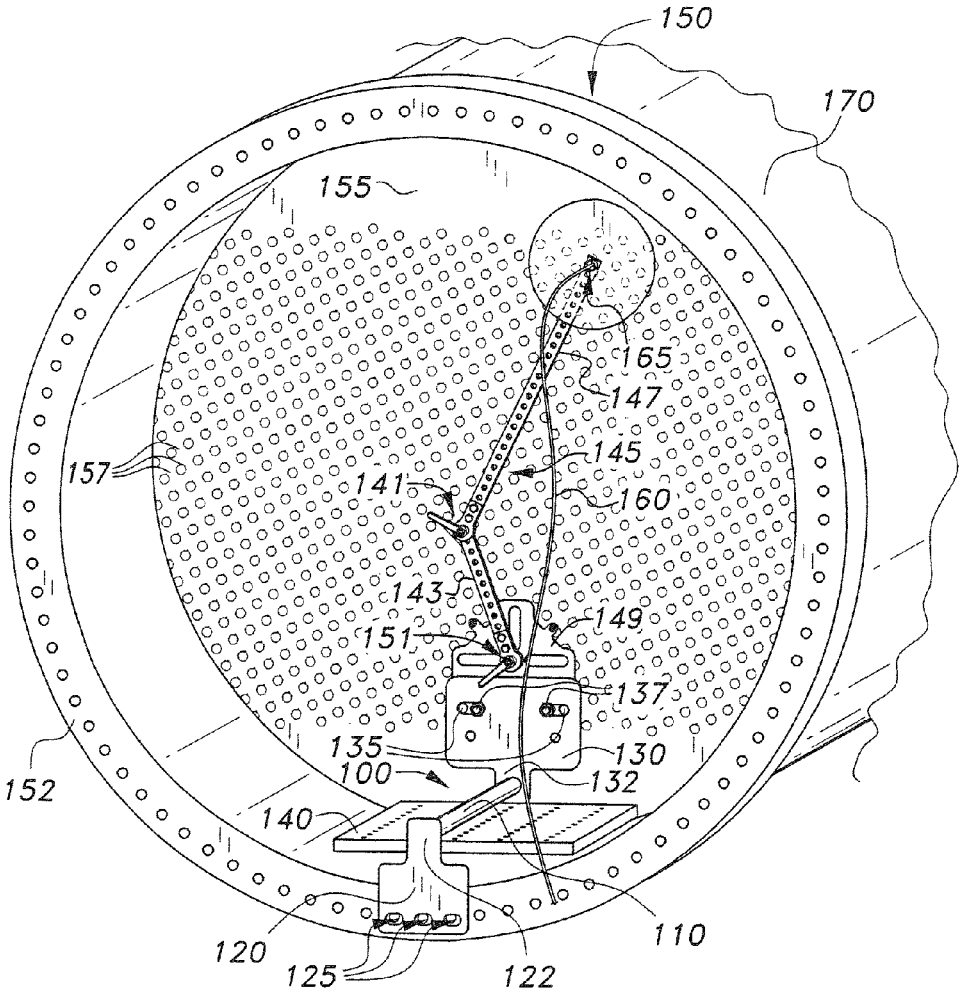
FIG. 1 is an environmental perspective view of a hydro-blasting anti-withdrawal device support according to the present invention.
Figure 2:
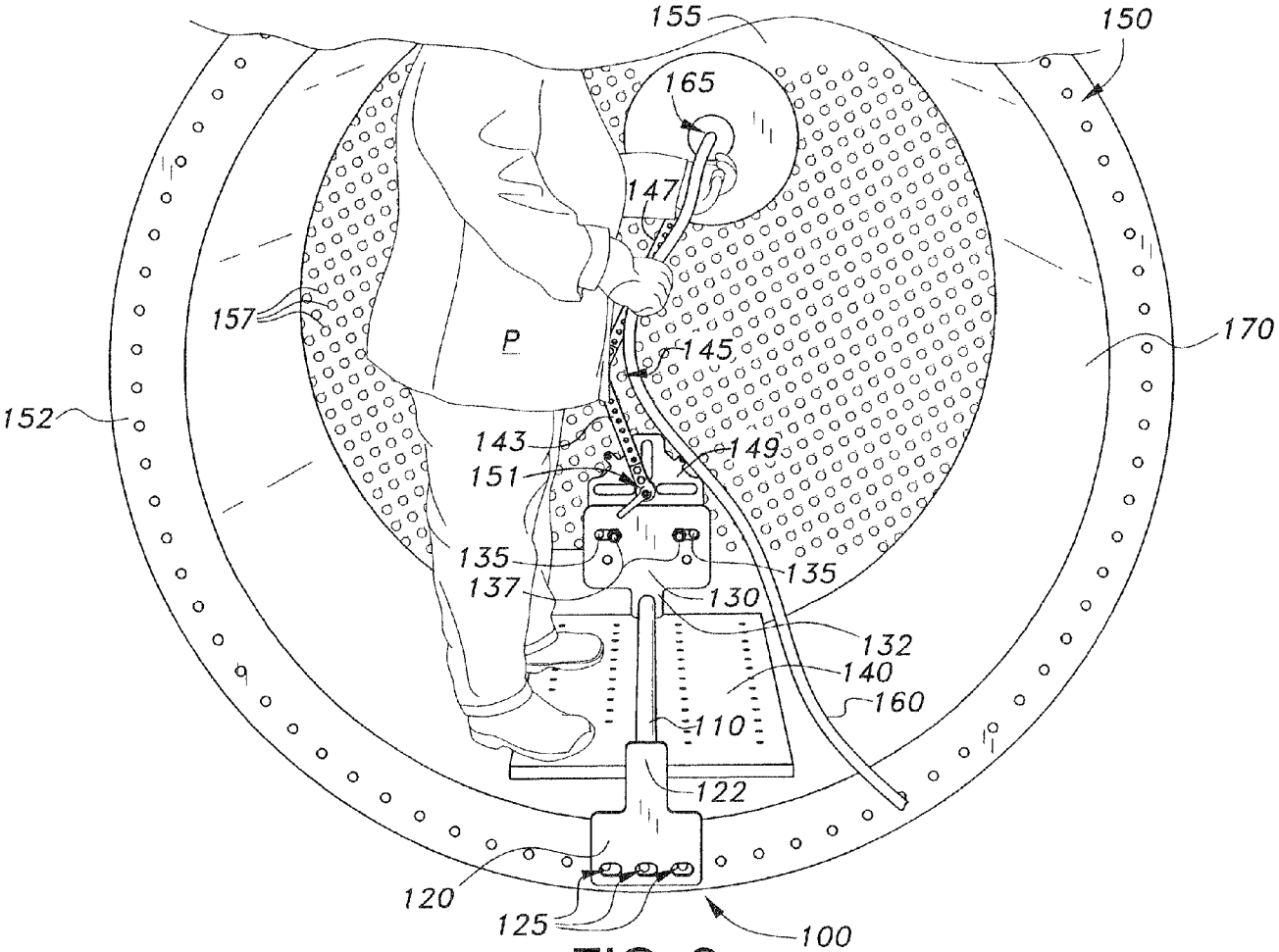
FIG. 2 is another environmental perspective view of a hydro-blasting anti-withdrawal device support according to the present invention.

As shown in FIGS. 1 and 2, a typical shell-and-tube heat exchanger 150 includes a shell 170, which is an elongated, hollow, generally cylindrical casing housing a plurality of tube bundles. Each tube is secured to a perforated tube sheet 155 by welding or by mechanical expansion joints with the tubes aligned with the perforations 157 so that a heat exchange fluid can flow through the tubes. The shell 150 has an annular flange 150 so that a cover or head can be bolted to one or both ends, the head directing the flow of the heat exchange fluid through the tubes. When the tubes become fouled by residues or deposits, as frequently happens during normal use, one way to clean the tubes is by removing the head from the flange and hydro-blasting the tubes with water under high pressure. The water is typically delivered by a hydro-blasting assembly, which may include a hose 160 having a lance 165 (which may be rigid or flexible) extending therefrom, a nozzle at the end of the lance and a footplate trigger 140. The lance 165 is inserted into each tube, and may be rotated or moved back and forth in a reciprocating movement to ensure that the entire length and internal circumference of the tube is cleaned.

Since the water is jetted into the tube under very high pressure during the hydro-blasting operation, there is a risk that the lance 165 and hose 160 might experience enough back pressure to shoot the lance 165 rearward out of the tube, exposing the workman P to impact from the hose 160 and lance 165 and exposure to a high pressure jet of water, with the attendant risk of accidental injury. In order to prevent such risk of injury, the lance 165 is usually secured by an anti-withdrawal device 145 for the health and safety of workers cleaning the tubes. A typical anti-withdrawal device 145 has a lower arm 143 attached to a base 149 (by a pivotal joint 151) extending therefrom that may be secured to the shell flange 152, an upper arm 147 that may be pivotally adjusted by an articulating or pivotal joint 141 to reach each perforation 157 in the tube sheet 155, and a clamping device at the end of the upper arm 147 for securing the lance 165. In order to secure the hose/lance to prevent accidental withdrawal from the heat exchanger tubes, the upper arm 147 must be in close proximity (on the order of one inch [2.5 cm]) to the tube sheet 155. When the tube sheet 155 is recessed from the end of the shell 170, clamping or securing the lower arm to the shell flange 152 leaves the end of the upper arm too far from the tube sheet 155 to adequately secure the hose 160 and lance 165. In some cases, for example, the tube sheet 155 may be recessed into the shell 170 by a distance on the order of 1.5 meters, leaving the AWD 145 too far from the tube sheet 155 to secure the hydro-blasting assembly.

In this case, the shell flange attachment plate 120 may be secured to the shell flange 152 using bolts extending through the slots 125 with the tab 125 extending upward so that the pipe may extend into the shell 170. The lower arm 143 of the anti-withdrawal device 145 is secured to the anti-withdrawal device (or AWD) attachment plate 130 using bolts 137 extending through the slots 135 and the base 149 to adjust the angle of the lower arm 143. The through-bores 137 may be used to attach the anti-withdrawal device (or AWD) attachment plate 130 to the tube sheet 155 or align the anti-withdrawal device (or AWD) attachment plate 130 with the tube sheet 155.

In this way, the hydro-blasting anti-withdrawal device support extends the anti-withdrawal device 145 far enough into the recess to allow the anti-withdrawal device 145 to properly secure the hydro-blasting assembly.

It is to be understood that the present invention is not limited to the embodiments described above, but encompasses any and all embodiments within the scope of the following claims.

I claim:

1. A hydro-blasting anti-withdrawal device support in combination with an anti-withdrawal device (AWD), comprising:

a shell flange attachment plate adapted for being secured to a shell of a shell-and-tube heat exchanger;

an anti-withdrawal device (AWD) attachment plate adapted for mounting an AWD thereon; and a pipe extending between and spacing the two plates apart;

an anti-withdrawal device having:

a base;

a lower arm pivotally attached to the base;

an upper arm pivotally attached to the lower arm; and a clamp disposed on the upper arm, the clamp being adapted for clamping a hydro-blasting assembly thereto;

wherein the support extends the anti-withdrawal device far enough into the shell of the shell-and-tube heat exchanger, the heat exchanger having a recessed tube sheet, to secure a hydro-blasting assembly for cleaning the tubes when the shell flange attachment plate is secured to the shell flange and the anti-withdrawal device is mounted on the AWD attachment plate.

* * * * *